US005997770A

United States Patent [19]

Ho et al.

[11] Patent Number: 5,997,770

[45] Date of Patent: Dec. 7, 1999

[54] PROCESS FOR DOPING POLYANILINE POWDER

[75] Inventors: Ko-Shan Ho, Taipei Hsien; Tar-Hwa Hsieh, Kaohsiung, both of Taiwan

[73] Assignee: Conpoly Technology Co., Ltd., Kaochung, Taiwan

[21] Appl. No.: 09/035,131

[22] Filed: Mar. 5, 1998

[51] Int. Cl.[6] ..... H01B 1/00

[52] U.S. Cl. ..... 252/500; 528/480

[58] Field of Search ..... 252/500; 528/480

[56] References Cited

U.S. PATENT DOCUMENTS 5,436,317 7/1995 Järvinen et al. ..... 252/500

5,470,505 11/1995 Smith et al. ..... 252/500

5,567,355 10/1996 Wessling et al. ..... 252/500

5,618,469 4/1997 Harlev et al. ..... 252/500

*Primary Examiner*—Terressa Mosley

*Attorney, Agent, or Firm*—Baker & Botts, L.L.P.

[57] ABSTRACT

A process for doping polyaniline powder includes: mixing a drying agent with a dopant selected from the group consisting of alkyl sulfuric acid, alkyl sulfonic acid and alkyl benzene sulfonic acid so as to remove water contained in the dopant; and blending the dried dopant and the polyaniline powder in the presence of an additive which is selected from the group consisting of phosphoric acid, hydrochloric acid, nitric acid and acetic acid in order to form a doped product.

5 Claims, 1 Drawing Sheet

PROCESS FOR DOPING POLYANILINE POWDER

BACKGROUND OF THE INVENTION

1. Field of the Invention

This invention relates to a process for doping polyaniline powder, more particularly to a process for doping polyaniline powder using a low water content dopant.

2. Description of the Related Art

Electrically conductive materials made of polyaniline powder (also known as emeraldine salt) are widely used to produce organic lighting devices, secondary batteries, anti-electrostatic coatings, conductive adhesives and coatings, electron beam photoresistive agents, sensors, electromagnetic wave shields, etc. A conventional process for producing such an electrically conductive material comprises the steps of mixing or doping undoped polyaniline with a dopant, i.e., a protonic acid selected from the group consisting of alkyl sulfuric acid, alkyl sulfonic acid and alkyl benzene sulfonic acid. A doping reaction takes place as follows:

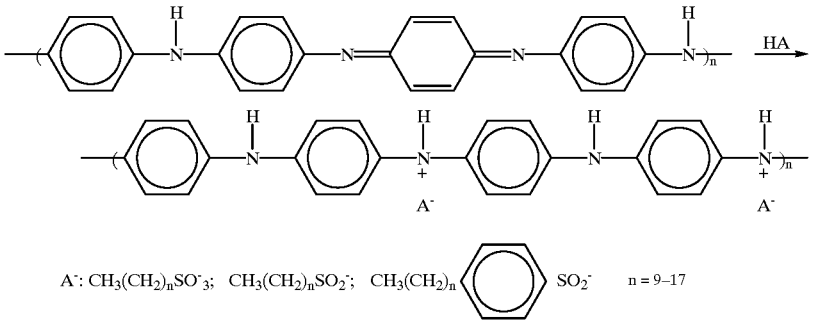

However, the conventional process suffers from the following disadvantages:

(1) Since the above-described dopants are apt to absorbing water and are both oily, the dopants cannot undergo a complete doping reaction with the polyaniline powder, thereby resulting in an oily doped product. When the doped product thus obtained is employed to produce anti-electrostatic conductive coatings or is used as a photoelectric material, the oily characteristics of the doped product affect adversely the adhesion or the processing of the doped product.

(2) Since the dopants cannot react completely with the polyaniline powder, the solubility of the doped product decreases, thereby resulting in difficulty to achieve a preferred situation in applying the doped product to an anti-electrostatic conductive material or a photoelectric material.

SUMMARY OF THE INVENTION

The object of the present invention is to provide a process for doping polyaniline powder (emeraldine), which can increase the solubility of the doped polyaniline powder with the long alkyl chains of the dopants.

According to the present invention, the process for doping polyaniline powder comprises:

(a) mixing a drying agent with a dopant selected from the group consisting of alkyl sulfuric acid, alkyl sulfonic acid, alkyl benzene sulfonic acid and dialkyl benzene sulfonic acid so as to remove water contained in the dopant; and (b) blending the dopant dried in step (a) and the polyaniline powder in the presence of an additive which is selected from the group consisting of phosphoric acid, hydrochloric acid, nitric acid and acetic acid in order to form a doped product.

Preferably, the process further comprises the step of applying heat to a temperature of 100–150° C. in step (b).

BRIEF DESCRIPTION OF THE DRAWINGS

Other features and advantages of the present invention will become apparent in the following detailed description of a preferred embodiment of the invention, with reference to the accompanying drawings, in which.

DETAILED DESCRIPTION OF THE PREFERRED EMBODIMENT

Figure 1:
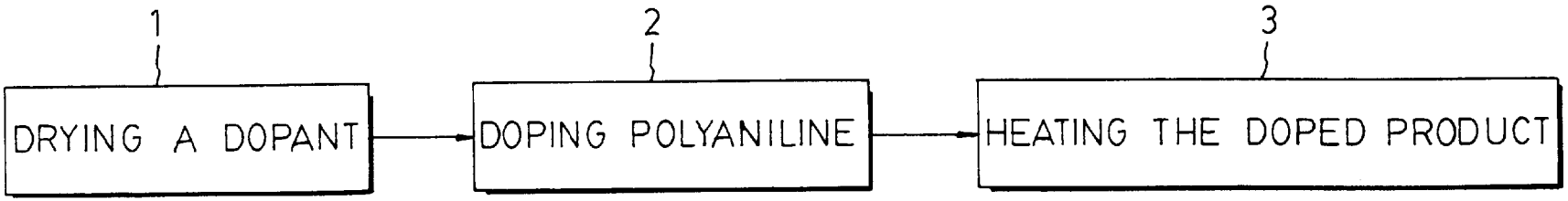
FIG. 1 is a flow diagram of the preferred embodiment of a process for doping polyaniline power according to the present invention.

Referring to FIG. 1, the preferred embodiment of a process for doping a polyaniline powder (emeraldine) according to the present invention is shown to comprise a drying step 1, a doping step 2 and a heating step 3. In the drying step 1, a dopant is mixed with the drying agent in order to remove water contained in the dopant. In the doping step 2, the dried dopant is mixed with a polyaniline powder and an additive to undergo an exothermal reaction. The dopant is selected from the group consisting of alkyl sulfuric acid, alkyl sulfonic acid, alkyl benzene sulfonic acid and dialkyl benzene sulfonic acid. The drying agent is selected from the group consisting of phosphoric anhydride, nitric anhydride, sulphuric anhydride, acetic anhydride, sodium sulfate, magnesium sulfate and calcium chloride. The additive is selected from the group consisting of phosphoric acid, hydrochloric acid, nitric acid and acetic acid. The weight ratio of the polyaniline powder, the dopant, the drying agent and the additive is 1:1~3:0.1~1:0.1~0.3. In the heating step 3, heat may be applied for about 1 minute to about 2 hours in the presence of the additive to reach a temperature of 100–150° C. in order to increase the degree of doping the polyaniline powder. A doped product with increased solubility is thus obtained without oily characteristics due to the high degree of doping.

The dopants, i.e., alkyl sulfuric acid, alkyl sulfonic acid, alkyl benzene sulfonic acid and dialkyl benzene sulfonic acid, used in the present invention may be prepared from sodium alkyl sulfate, sodium alkyl sulfonate or sodium alkyl benzene sulfonate which is formed into a 10% suspension by adding chloroform. Concentrated sulfuric acid is slowly added into the suspension while the suspension is stirred until the color of the suspension changes. The solution is continuously stirred overnight and is then kept still for two hours. The resulting upper liquid phrase is poured into a Petri dish, and the residual solvent thereof is removed so as to obtain alkyl sulfuric acid, alkyl sulfonic acid or alkyl benzene sulfonic acid.

EXAMPLE

A emeraldine salt of polyaniline, dodecyl benzene sulfonic acid (DBSA), sodium sulfate and hydrochloric acid are used at a ratio of 1:2:1:0.2. The dodecyl benzene sulfonic acid and the sodium sulfate are mixed to remove the water contained in the dodecyl benzene sulfonic acid.

The emeraldine (polyaniline powder), dodecyl benzene sulfonic acid and hydrochloric acid are mixed for about 3 minutes to undergo an exothermal reaction, thereby forming a mixture having a temperature of about 70° C. The mixture is heated in an oven at a temperature over 100–150° C. for about 5 minutes to about 1 hour in order to enhance the doping effect of the dodecyl benzene sulfonic acid. The reaction thereof is as follows:

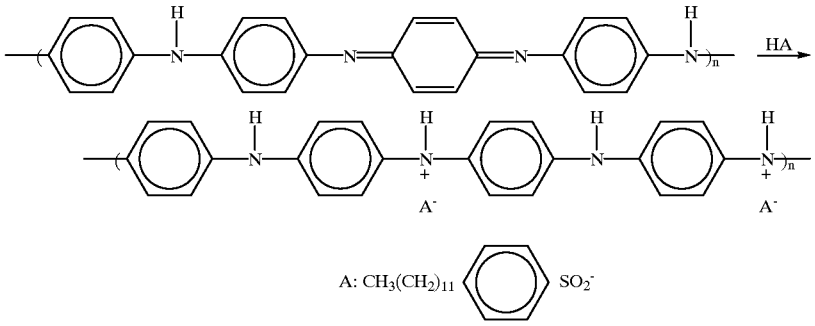

It is noted that the dodecyl benzene sulfonic acid is doped totally with the emeraldine. Therefore, the oily characteristics resulting from incomplete doping of the dopant in the polyaniline powder is eliminated.

While the present invention has been described in connection with what is considered the most practical and preferred embodiment, it is understood that this invention is not limited to the disclosed embodiment but is intended to cover various arrangements included within the spirit and scope of the broadest interpretations and equivalent arrangements.

I claim:

1. A process for doping polyaniline powder, comprising:

(a) mixing a drying agent with a dopant selected from the group consisting of alkyl sulfuric acid, alkyl sulfonic acid, alkyl benzene sulfonic acid and dialkyl benzene sulfonic acid so as to remove water contained in said dopant; and (b) blending said dopant dried in step (a) and the polyaniline powder in the presence of an additive which is selected from the group consisting of phosphoric acid, hydrochloric acid, nitric acid and acetic acid in order to form a doped product.

2. The process for doping polyaniline powder as claimed in claim 1, further comprising the step of applying heat to a temperature of 100–150° C. in step (b).

3. The process for doping polyaniline powder as claimed in claim 1, wherein said dopant contains an alkyl group having a carbon number of 10~18.

4. The process for doping polyaniline powder as claimed in claim 1, wherein said drying agent is selected from the group consisting of phosphoric anhydride, nitric anhydride, sulphuric anhydride, acetic anhydride, sodium sulfate, magnesium sulfate and calcium chloride.

5. The process for doping polyaniline powder as claimed in claim 1, wherein the weigh ratio of said polyaniline powder, said dopant, said drying agent and said additive is 1:1~3:0.1~1:0.1~0.3.

* * * * *